United States Patent [19]

Du Gardin et al.

[11] Patent Number: 4,725,059

[45] Date of Patent: Feb. 16, 1988

[54] RACKET HAVING DIFFERENT PORTIONS COMPRISED OF DIFFERENT MATERIALS

[75] Inventors: Gilles Du Gardin, Voiron; Roger Macaire, Tullins, both of France

[73] Assignee: Skis Rossignol S.A., Voiron, France

[21] Appl. No.: 2,137

[22] Filed: Jan. 12, 1987

[30] Foreign Application Priority Data

Jan. 13, 1986 [FR] France ..... 86 00726

[51] Int. Cl.[4] ..... A63B 49/10

[52] U.S. Cl. ..... 273/73 G; 273/DIG. 23; 273/DIG. 7; 273/73 J; 273/DIG. 16; 273/DIG. 4; 273/DIG. 8; 273/73 C; 273/73 F

[58] Field of Search ..... 273/73 R, 73 C, 73 D, 273/73 F, 73 G, 73 H, 73 K, 73 J, DIG. 7, DIG. 23

[56] References Cited

U.S. PATENT DOCUMENTS 4,177,990 12/1979 Kajiwara ..... 273/73 C 4,340,226 7/1982 Haines ..... 273/73 J X

*Primary Examiner*—Richard C. Pinkham

*Assistant Examiner*—Matthew L. Schneider

*Attorney, Agent, or Firm*—Karl F. Ross; Herbert Dubno

[57] ABSTRACT

A racket body formed of composite materials in which the shaft portion of the handle, two branches of a throat portion and a frame portion, which can be completed by a bridging portion, adjoin in end to end relationship and have cores and sheaths composed of different materials. The sheaths are comprised of fiber webs or braids impregnated with synthetic resin, the fibers differing along the length of the racket from at least one portion to another, while the orientations of the fibers with respect to the axes of the respective cores can differ from place to place as well. The end portions of thetwo branches of the throat are axially offset from one another so as to avoid the formation of a rupture zone.

7 Claims, 9 Drawing Figures

RACKET HAVING DIFFERENT PORTIONS COMPRISED OF DIFFERENT MATERIALS

FIELD OF INVENTION

Our present invention relates to rackets and, particularly, to tennis rackets and the like which comprise a racket body adapted to be strung to form a ball-striking racket face. The invention specifically relates to tennis rackets, squash rackets, badminton rackets and racket ball rackets which all generally comprise a head formed by a frame which is strung in the manner described and which is connected by a throat to a shaft portion of a handle formed with a grip. The invention deals specifically with the body of such a racket where the body is of the type which has a core or mandrel formed with one or more layers, i.e. is a laminated or composite material with layers of synthetic resin in which fibers are embedded.

BACKGROUND OF THE INVENTION

Most racket bodies formed from composite materials utilizing, for example, glass fibers and/or carbon fibers, are made by wrapping a web of woven or nonwoven fiber, hereinafter referred to as fabric or mats of fiber, preimpregnatable with a hardenable resin around a mandrel or core constituted of a cellular material (synthetic resin foam or the like) or around an air chamber which is somewhat inflated or under pressure. The web of impregnatable material can extend all along the mandrel or core and consequently, has essentially the same orientation of the fibers where the web forms the arms or branches of the throat piece, any bridge between these branches, the frame portion and, of course, the handle or shaft of the racket body. The latter parts can be formed separately and then joined together with local reinforcement at the junctions.

Another method of forming such rackets is to provide fiber braids around a flexible mandrel which is inflatable or thermally deformable and to impregnate the fiber armature which is thus formed with a resin under pressure. In this case as well the fibers extend over the entire length of the body and the only discontinuities of the structure are constituted by any reinforcements which may locally be required or desirable.

Both of these processes require the use of relatively expensive materials such as carbon fibers, in zones of the racket where they may not be necessary for the required level of strength and the function at the respective portions of the racket. Furthermore, the orientations of the fibers is uniform over the entire length of the body with respect to the axis of the core or mandrel and thus in many parts of the racket, the orientation is not conditioned upon the force distribution required at the particular portion.

Furthermore, when a flexible core or mandrel is used, impregnation of the armature by injection of the synthetic resin under pressure can result in compression of the mandrel under the effect of the resin pressure and this compression tends to increase toward the point of injection which results in a distribution of resin which decreases remotely from this injection point. At part of the racket body, therefore, there is an excess of resin which does not go to improve the strength of the racket but only has an adverse effect upon the weight of the racket body, whereas in other regions, the lack of resin may result in a diminished strength.

OBJECT OF THE INVENTION

The principal object of this invention is to provide an improved racket body whereby these drawbacks are avoided, i.e. the quantities of resin and the orientations of the fibers can be selected for the strength and functional requirements of the racket body, and it is no longer necessary to utilize expensive materials where the strength and functional requirements of the racket body can allow inexpensive material to be used.

SUMMARY OF THE INVENTION

This object and others which will become apparent hereinafter are attained, in accordance with the invention by providing at least two of the adjoining portions of the racket, usually at least the shaft portion and the throat portion or the throat portion and the frame portion, of core and sheath elements which follow one another from junction zone to junction zone but are different from one another as to the nature of the mandrel which constitutes the core and as to the nature of the fibers of the fiber web, or fabric wrapped around the mandrel or core, the junction zones being formed by local overlapping of the sheathes. An important feature of the invention is that the mandrels or cores of the two branches of the principal armature (forming the throat portion and the frame portion) terminate in a region of the shaft portion in which they are axially offset from one another. The sheaths of these two branches likewise are axially offset from one another. By pregluing of the parts end to end, we are able to facilitate mounting and can provide local reinforcement of the connection of the elements of the racket body.

The invention is applicable not only to a racket body formed from two such elements, i.e. a frame and a handle, but also to other body types, including, for example, rackets in which the frame portion is connected to the handle portion by one or more branches having the same composition as the frame portion and different from that of the handle portion, but also different, if desired, from the frame portion. Where a bridge portion is provided between the branches, it can have a composition different from that of the branches and, of course, the frame portion and the handle portion.

The racket body of the invention can be realized at a significantly reduced cost and improved ratio of strength to weight because the orientations of the fibers and the fiber composition can be selected for each of the portions described as a function of the mechanical constraints of the particular region of the racket body.

The invention is also applicable to systems in which a resin is injected under pressure into a fiber armature based upon braids surrounding the flexible mandrel without the drawbacks of earlier systems since it allows the mandrel or core material to be composed of a less compressible composition proximal to the point of injection and more compressed composition remote therefrom. A more uniform distribution of the resin is therefore insured which contributes to the quality of the product.

According to the invention, therefore, a racket body adapted to be strung to form a ball-striking racket face can comprise:

a handle formed with a shaft portion;

a pair of branches forming a throat portion connected to the shaft portion; and a head formed with a frame portion connected to the throat portion, each of the portions being formed with a core enveloped by a sheath of a fiber web impregnated with a synthetic resin which is hardened, the shaft portion, the throat portion and the frame portion forming zones of cores and respective sheaths which successively adjoin one another along the body at respective junction regions, the adjoining zones of cores and respective sheaths of at least the shaft portion and the throat portion having both cores and sheaths of different compositions, at least the sheaths of the adjoining zones at each of the junction regions overlapping one another, and ends of the branches and the core of the shaft portion being axially offset from one another at the junction region at which the zones of the shaft portion and the throat portion adjoin.

The ends of the sheaths of the branches can also be offset axially from one another at the junction region at which the zones of the shaft portion and the throat portion adjoin.

A bridge portion can be provided between the branches of the throat portion and is also formed with a core enveloped by a sheath of a fiber web impregnated with a synthetic resin which is hardened, the bridge portion forming a further such zone adjoining the throat portion at further junction regions between the cores and sheaths thereof at which the core and sheath compositions differ from one another.

The frame portion can have its core and sheath formed continuously with the cores and sheaths of the branches of the throat portion.

Three distinct ones of the zones can be provided at which the core and sheath compositions differ, namely the zone between the frame portion and the throat portion, the zone between the throat portion and the bridge portion, and the zone between the throat portion and the shaft portion.

Preferably:

the core of the frame portion is composed of a polyethylene foam;

the cores of the branches are composed of a semirigid polyurethane foam;

the core of the bridge portion is composed of a rigid polyurethane foam;

the core of the shaft portion is composed of an acrylic foam;

the fiber web of the sheath of the frame portion has its fibers composed of carbon and oriented at an angle $\alpha$ with the axis of the respective core;

the fiber webs of the sheaths of the branches have their fibers composed of glass and of carbon and oriented at an angle $\beta$ with respect to the axes of the respective cores;

the fiber web of the sheath of the bridge portion has its fibers composed of glass and oriented at an angle $\gamma$ with the axis of the respective core; and the fiber web of the sheath of the shaft portion has its fibers composed of glass and oriented at an angle $\delta$ with the axis of the respective core, at least one of the angles being different from others of the angles.

The core of the frame portion and the branches can be composed of a flexible foam and at least three successive braided layers of fiber can be applied to the flexible foam core in respective thicknesses, including a central thickness composed of a majority of carbon fibers and outer thinner layers composed substantially of glass fibers. The core of the shaft portion can then be composed of a rigid foam while at least two thick braids of glass fiber are provided on the rigid foam core and are locally overlapped with the three braided layers at a junction region between the branches and the shaft portion.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 8:
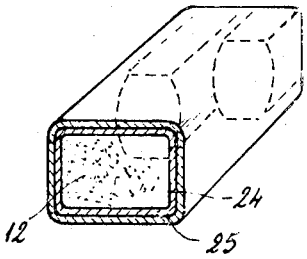
Figure 9:
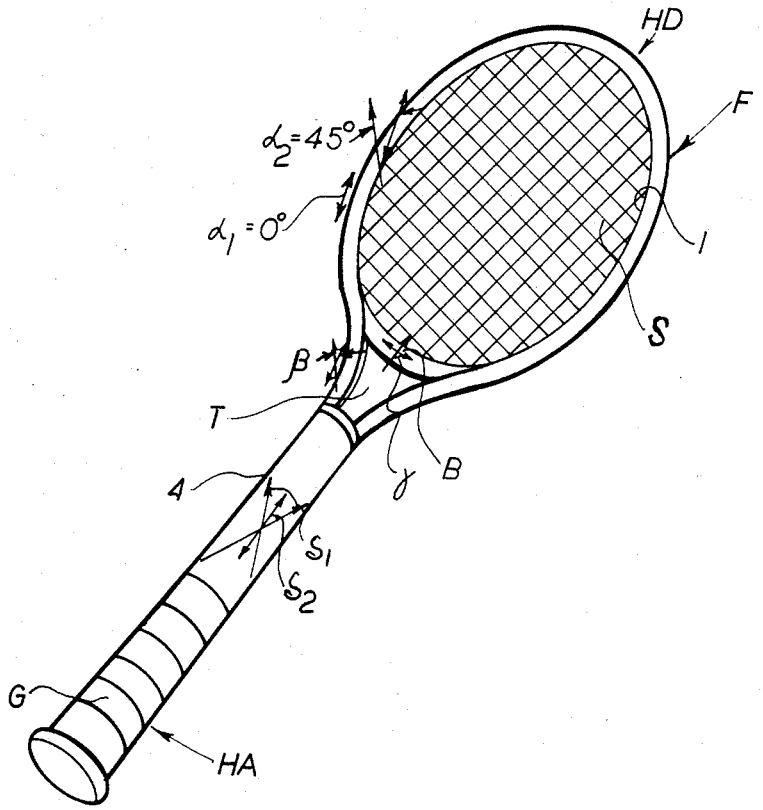
FIG. 9 is a perspective view of a tennis racket using the body of the invention.

Referring first to FIG. 9, where a tennis racket formed from one of the bodies of FIGS. 1–8 described below is used, it can be seen that the tennis racket generally comprises a handle HA with a grip G formed by tape wrapped around and bonded to this handle, a shaft portion 4 of the handle extending beyond the grip, a throat portion T defined by a pair of branches 2 spreading outwardly and secured to the shaft portion 4, a head HD connected to the throat portion T, stringing S forming a racket face and, if desired, a bridge portion B connecting the branches 2 and frame portion F formed by an oval frame member 1 delimiting the head HD.

To illustrate fiber direction patterns which we will discuss below, it can be seen that the shaft portion and the handle can be provided with a wrap of a fiber web or fabric or a braid whose main fiber direction can include angles $\alpha_1$ and $\alpha_2$ with the axis of the respective core shown with a double-headed arrow.

In the frame F the fibers can form angles with the axis of the respective core also represented by a double-headed arrow while the angles $\alpha$ and $\gamma$ are the angles formed by the fiber directions with the axes of the respective branches and of the bridge portion, respectively.

In the various portions of the racket, therefore, not only may the respective fiber materials be different, but the fibers of each portion may define different angles with the respective core axes and, indeed the core materials may differ in the longitudinal direction along the racket, i.e. from the handle to the end of the head.

As will be apparent from FIGS. 1–5 and FIGS. 6–8 which utilize similar reference numerals for corresponding structural elements, the body of the racket is constituted by the frame portion 1, two branches 2 of the throat portion, a bridge portion 3 and a shaft portion 4 of the handle. The assembly 1, 2 forms the principal reinforced structure of the body.

According to the invention:

(a) the frame portion 1 is formed by wrapping a nonwoven fiber web of carbon fibers 5 around a core of polyethelene foam, the fibers 5 having, with respect to the axes of this core, an orientation $\alpha$;

(b) each of the two branches is formed by wrapping the nonwoven web 7 of glass and carbon fibers around a mandrel or core 8 of semirigid polyurethane foam, the wrapping fibers forming an angle $\beta$ with respect to the longitudinal axis of the respective branches.

The bridge 3 is also formed by wrapping the nonwoven fiber web 9 of the glass and carbon fibers around a core 10 constituted of rigid polyurethane with the wrapping fibers forming with the longitudinal axis of the bridge portion an angle $\lambda$ which can be different from the angles $\alpha$ and $\beta$ previously mentioned;

the terminal zones 17, 18 of the cores 8 of the two branches in the core 12 of the shaft portion 4 are offset from one another along the longitudinal axis of the racket to avoid the formation of any rupture zone and thereby guaranty sufficient strength and resistance to breakage at this junction zone;

the terminal zones 19 and 20 of the fabric web 7 in the shaft portion 4 which are wrapped around the cores 8 of the two branches 2 are also offset axially with respect to one another; and The shaft portion 4 is formed by wrapping the glass fiber web 11 around the core 12 which is composed of an acrylic foam so that the fibers of this web form an angle $\delta$ with respect to the axis of the core.

In addition, the fibers of each web can form, with respect to the axis of the respective core, different angles (for example, $\alpha_1=0$, $\alpha_2=45°$) depending upon the different constraints associated with each of the zones. In the junction zones, moreover, there is an overlapping of the sheaths of the adjoining portions.

It will also be clear from the foregoing that the nature of the core and of the fiber web differs between the foreportions and from one to another so that it is possible to provide at each zone structural and strength characteristics taking account of the constraints of that zone. This eliminates any problem with excess use of resin and allows a reduction with both the weight and price of the racket without loss of strength and ensures a uniform distribution of the resin over the entire body when the resin is injected. Whether or not the resin usually an epoxy or other thermosetting resin is injected or applied by impregnating the respective web before it is applied to the core, the hardened resin in which the fiber web is embedded forms a sheath for the respective portion.

The overlap in the junction zones is illustrated at 13 at the junction of the frame portion 1 with the branches to the throat portion, at 14 for the junction of the bridge portion 3 with the frame portion 1 and the branches 2 and at 15 at the junction of the shaft portion 4 with the branches 2. This connection involving overlapping and impregnation with resin can be supplemented by gluing the cores in the region of overlap in end to end relationship.

Figures 1, 2, 3, 4, 5:
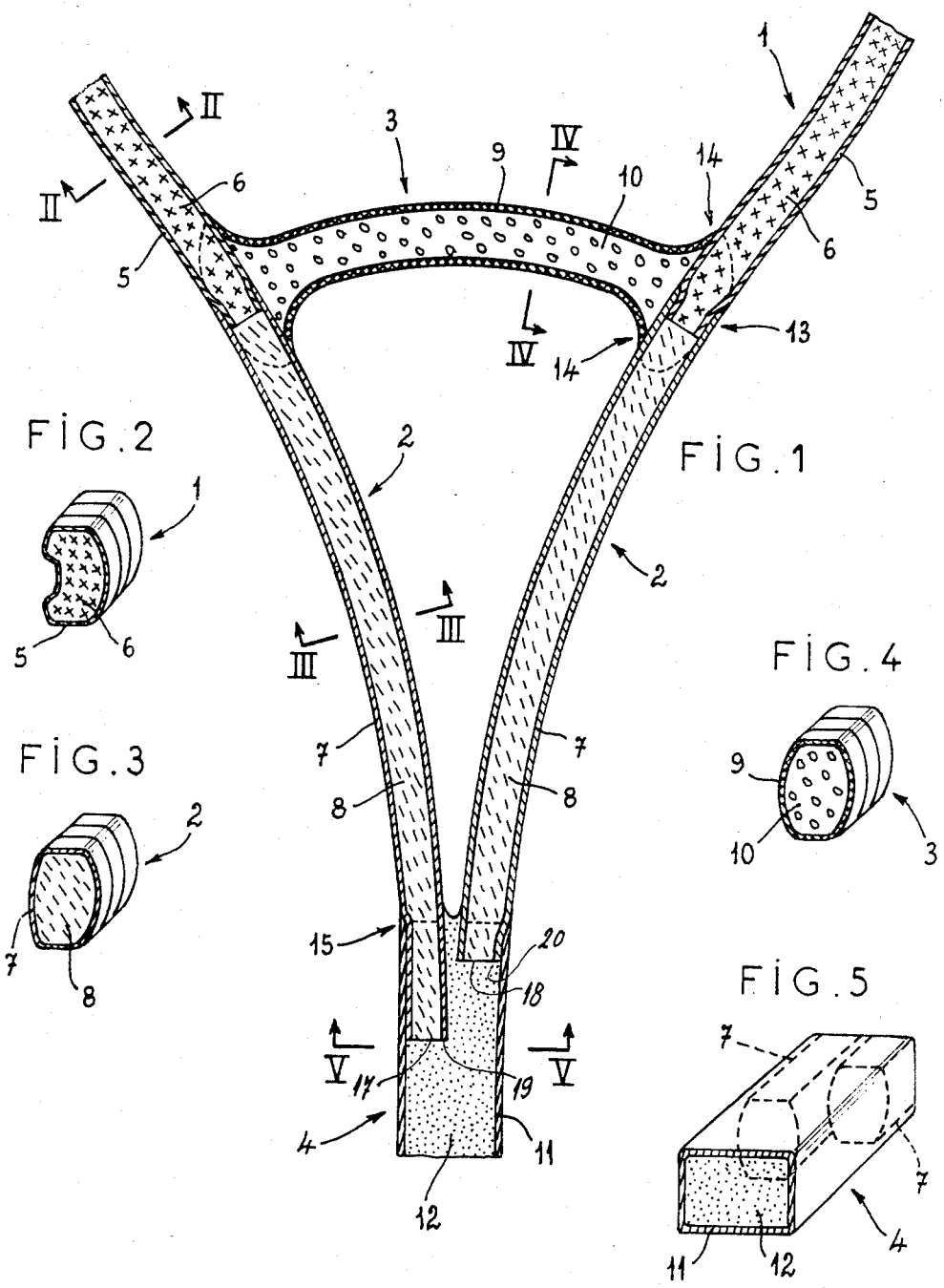
FIG. 1 is a partial cross-sectionalview with the cross section being taken in a plane parallel to the longitudinal axis of the core parts, illustrating only the junction regions between the frame, bridge, throat and shaft portions of a racket, namely, a tennis racket according to the invention.
FIGS. 2–5 are, respectively, cross-sectional views along lines II—II, III—III, IV—IV and V13 V of FIG. 1, drawn to a larger scale.
Figure 6:
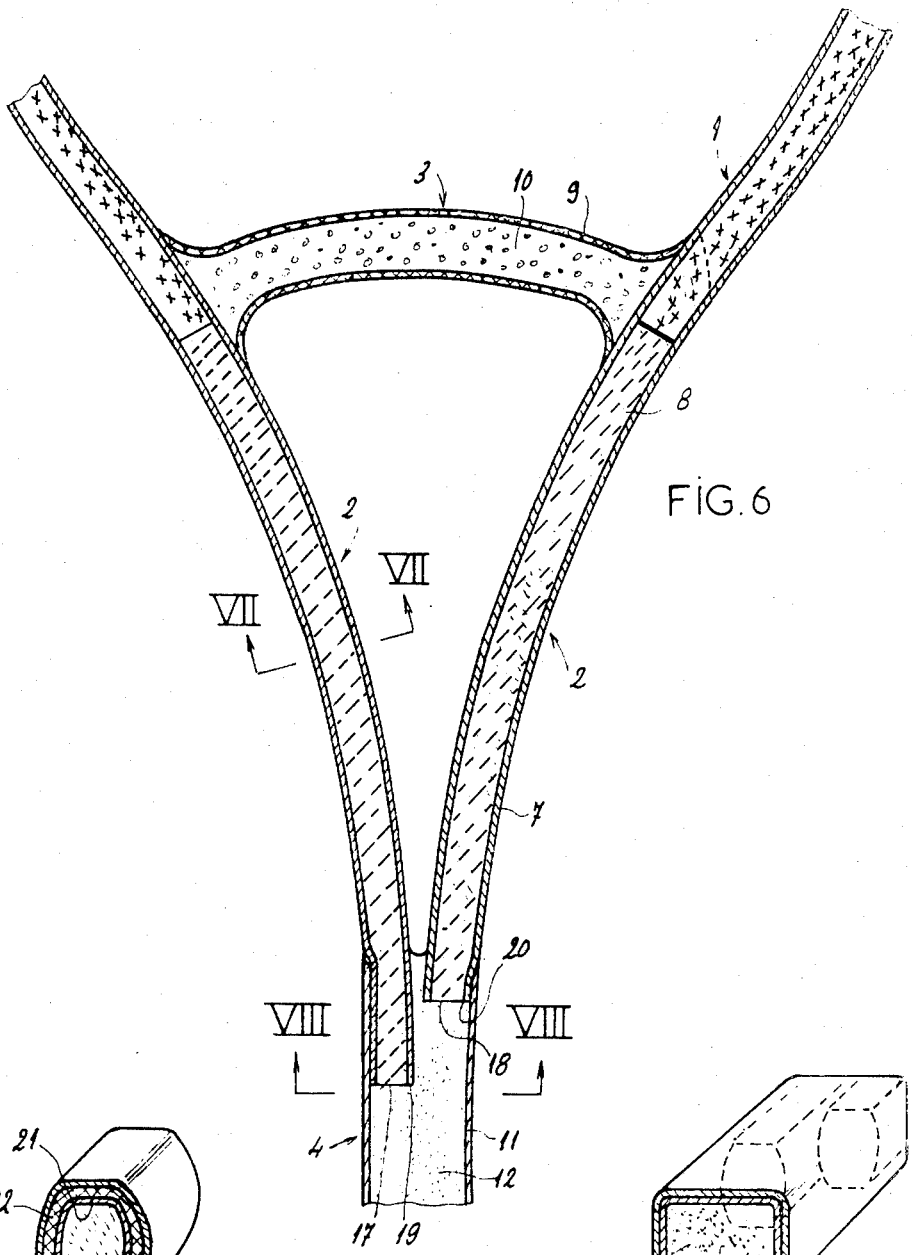
FIG. 6 is a partial section similar to FIG. 1 illustrating another embodiment of the invention.
Figure 7:
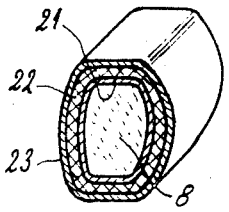
FIGS. 7 and 8 are perspective views along lines VII—VII and VIII—VIII respectively of FIG. 6.

In the embodiment of FIGS. 6–8, the bridge 3 can be identical to that of the racket body described earlier and can be formed by covering the core 10 which is a rigid foam with two braids 9 of glass fiber and carbon fiber. These braids are cut slightly larger than the core 10 so that their end fibers can be spread along the branches 2 and the frame member 1 so that they can be bonded in the latter by the resin.

The principal armature of the body formed at the two branches 2 and the frame member 1 has a continuous single core 8 of a flexible foam such as a polyethelene foam. The yieldable mandrel is covered by three successive braids forming three fiber thicknesses. These include a central thickness 21 having a high percentage of carbon fibers (for example, 70% carbon fibers and 30% glass fibers) located between two thinner layers 22 and 23 of glass fibers.

As in the first embodiment, the terminal zones 17, 18, 19 and 20 of the ends of the core 8 and its sheath constituted by the three textile webs 21, 22, 23 in the shaft portion 4 are offset axially from one another to avoid the formation of a preferential rupture zone.

The core 12 of the handle and shaft portion 4 is constituted as a rigid foam such as an acrylic foam, and is covered at 11 by two thick braids 24, 25 of glass fibers. These coarse braids are less expensive than those constituting the sheath 7 and the branches 2 and the frame member 1. In FIGS. 7 and 8 the relative thickness of the braids and sheaths may not be clear from the drawing which is not done to scale, but it will be understood that the braids 24, 25 should be significantly thicker than the braids 22. 23.

As in the preceding embodiment, the junction between the shaft portion 24 and the branches 2 is effected by at least several centimeters of overlapping of the sheaths 7 by the sheath 11. This connection by overlapping of the fabric webs and by impregnation to form the overlapping sheaths can be completed by gluing end to end the cores 8 and 12.

The invention is not, of course, limited to the embodiments described in detail but also comprehends all variants within the spirit and scope of the appended claims and include, for example, systems in which pieces of braid are added supplementarily at the top of the frame not the base of the bridges or elsewhere for local reinforcement of the most sensitive zones of the racket body.

We claim:

1. A racket body adapted to be strung to form a ball-striking racket face and comprising:

a handle formed with a shaft portion;

a pair of branches forming a throat portion and having ends connected to said shaft portion; and a head formed with a frame portion connected to said throat portion, each of said portions being formed with a core enveloped by a sheath of a fiber web impregnated with a synthetic resin which is hardened, said shaft portion, said throat portion and said frame portion forming zones of cores and respective sheaths having ends which successively adjoin one another along said body at respective junction regions, the adjoining zones of cores and respective sheaths of at least said shaft portion and said throat portion having both cores and sheaths of different compositions, at least the sheaths of the adjoining zones at each of said junction regions overlapping one another, and the ends of said branches and the core of said shaft portion being axially offset from one another at said junction region at which the zones of said shaft portion and said throat portion adjoin.

2. A racket body as defined in claim 1 wherein the ends of the sheaths of said branches are also offset axially from one another at said junction region at which the zones of said shaft portion and said throat portion adjoin.

3. A racket body as defined in claim 1 wherein a bridge portion is provided between said branches of said throat portion and is also formed with a core enveloped by a sheath of a fiber web impregnated with a synthetic resin which is hardened, said bridge portion forming a further such zone adjoining said throat portion at further junction regions between the cores and sheaths thereof at which the core and sheath compositions differ from one another.

4. A racket body as defined in claim 3 wherein three distinct ones of said zones are provided at which the core and sheath compositions differ, namely the zone between said frame portion and said throat portion, the zone between said throat portion and said bridge portion, and the zone between said throat portion and said shaft portion.

5. A racket body as defined in claim 3 wherein:

the core of said frame portion is composed of a polyethylene foam;

the cores of said branches are composed of a semi-rigid polyurethane foam;

the core of said bridge portion is composed of a rigid polyurethane foam;

the core of said shaft portion is composed of an acrylic foam;

the fiber web of the sheath of said frame portion has its fibers composed of carbon and oriented at an angle $\alpha$ with the axis of the respective core;

the fiber webs of the sheaths of said branches have their fibers composed of glass and of carbon and oriented at an angle $\beta$ with respect to the axes of the respective cores;

the fiber web of the sheath of said bridge portion has its fibers composed of glass and oriented at an angle $\gamma$ with the axis of the respective core; and the fiber web of the sheath of said shaft portion has its fibers composed of glass and oriented at an angle $\delta$ with the axis of the respective core, at least one of said angles being different from others of said angles.

6. A racket body as defined in claim 1 wherein the frame portion has its core and sheath formed continuously with the cores and sheaths of the branches of the throat portion.

7. A racket body as defined in claim 6 wherein:

the core of said frame portion and said branches is composed of a flexible foam;

the sheath enveloping the flexible foam comprises at least three successive braided layers of fiber including a central thickness composed of a majority of carbon fibers and outer thinner layers composed substantially of glass fibers;

the core of said shaft portion is composed of a rigid foam; and the sheath enveloping the rigid foam comprises at least two thick braids of glass fiber which are locally overlapped with the three braided layers at a junction region between said branches and said shaft portion.

* * * * *